United States Patent [19]

Rossall et al.

[11] 4,235,752

[45] Nov. 25, 1980

[54] DETERGENT COMPOSITIONS CONTAINING ALKYL SULFATE ISOMERS

[75] Inventors: Brian Rossall; Jeffrey D. Hampson, both of Wirral, England

[73] Assignee: Lever Brothers Company, New York, N.Y.

[21] Appl. No.: 10,666

[22] Filed: Feb. 9, 1979

[30] Foreign Application Priority Data

Feb. 14, 1978 [GB] United Kingdom ..... 5837/78

[51] Int. Cl.[2] ..... C11D 1/14; C11D 1/22

[52] U.S. Cl. ..... 252/551; 252/545; 252/547; 252/550; 252/552; 252/553; 252/DIG. 14

[58] Field of Search ..... 252/531, 533, 550, 353, 252/552, 553, 545

[56] References Cited

U.S. PATENT DOCUMENTS

| | | | |
|---|---|---|---|
| 2,500,107 | 3/1950 | Weichelbaum | 252/550 |
| 3,395,170 | 7/1968 | Walts et al. | 260/458 |
| 3,413,331 | 11/1968 | Beiser et al. | 260/458 |
| 3,468,805 | 9/1969 | Grifo et al. | 252/550 X |
| 3,480,556 | 11/1969 | De Witt et al. | 252/550 X |
| 3,513,099 | 5/1970 | Hans et al. | 252/553 X |
| 4,052,342 | 10/1977 | Fernley et al. | 252/541 |

FOREIGN PATENT DOCUMENTS

| | | | |
|---|---|---|---|
| 1468825 | 1/1969 | Fed. Rep. of Germany | 260/459 R |
| 818367 | 8/1959 | United Kingdom | 252/553 |

OTHER PUBLICATIONS

Livingston, J. R., et al., "Detergency and Biodegradability of Alcohol-Based see-Sulfates," Industrial and Engineer Chemistry-Product Research and Development, vol. 4, Mar. 1969, pp. 28-32.

*Primary Examiner*—P. E. Willis, Jr.

*Attorney, Agent, or Firm*—Michael J. Kelly; James J. Farrell; Melvin H. Kurtz

[57] ABSTRACT

Detergent compositions useful more particularly, but not exclusively, for dishwashing, comprising as active detergent ingredient a $C_{10}$–$C_{18}$ secondary alkyl sulphate, said secondary alkyl sulphate containing up to 50% of 2,3 sulphate isomers and at least 40% of effective isomers selected from the group consisting of $C_{14}{}^{-2}$, $C_{15}{}^{-2/3/4/5/6}$, $C_{16}{}^{-3/4/5/6/7}$ and $C_{17}{}^{-7/8/9}$ isomers, and mixtures thereof.

Preferred compositions having improved dishwashing properties comprise further a co-surfactant and an alkylbenzene sulphonate.

8 Claims, No Drawings

DETERGENT COMPOSITIONS CONTAINING ALKYL SULFATE ISOMERS

This invention relates to detergent compositions useful more particularly, but not exclusively, for dishwashing.

This invention also relates to a method of washing dishes utilising such detergent compositions and to specific secondary alkyl sulphate compositions suitable for use in such detergent compositions.

The term "dishes" is used herein to indicate utensils which may be required to be washed to free them from food particles and other food residues, greases, proteins, starches, gums, dyes, oil and burnt organic residues.

Liquid detergent compositions, such as are used in manual dishwashing, are well known and have met with a high degree of acceptance by consumers because of their good washing and foaming properties and convenient form for use.

Most of the formulations in commercial use at the present time are based on synthetic organic detergents, which together with supplementing materials often employed, given them satisfactory detergency and foaming properties. The main synthetic organic detergent used in such compositions is formed by the group of alkylbenzene sulphonates. Nevertheless research continues in an effort to provide alternatives for alkylbenzene sulphonates which are more environmentally acceptable. Secondary alkyl sulphates (SALS) are one of the most promising alternatives in this respect but their performance is generally rather poor as compared with the alkylbenzene sulphonates hitherto used.

Secondary alkyl sulphates have been known for some time as synthetic organic detergent material. They are generally prepared from straight chain $C_{10}$–$C_{18}$ alpha-olefins or internal olefins and, depending on the reaction conditions during sulphation, it is possible to produce $C_{10}$–$C_{18}$ secondary alkyl sulphates having the sulphate group predominantly in the 2- or 3-position of the alkyl chain, or $C_{10}$–$C_{18}$ secondary alkyl sulphates having the sulphate group more randomly distributed on the alkyl chain.

Netherlands Patent Application No. 7607823 describes the use of such $C_{10}$–$C_{18}$ secondary alkyl sulphates in detergent compositions. Two types of $C_{10}$–$C_{18}$ secondary alkyl sulphates are used in the Netherlands patent application, viz one type defined as having more than 80% of the sulphate group in the 2- or 3-position and another type defined as having less than 80% of the sulphate group in the 2- or 3-position. However, without a proper selection of the SALS-components, compositions prepared therewith are generally still disappointing in their dishwashing performance as compared with dishwashing compositions based on alkylbenzene sulphonate.

The present invention now provides secondary alkyl sulphates which clean and foam better than the secondary alkyl sulphates hitherto known.

They can be used to replace wholly or partially alkylbenzene sulphonates in liquid detergent compositions with better cleaning and foaming properties.

$C_{10}$–$C_{18}$ secondary alkyl sulphates may consist of any of the following 56 compounds, the suffix number indicating the carbon atom number on the alkyl chain on which the sulphate group is attached:

| | | | | | | | | |
|---|---|---|---|---|---|---|---|---|
| $C_{10}^{-2}$ | $C_{11}^{-2}$ | $C_{12}^{-2}$ | $C_{13}^{-2}$ | $C_{14}^{-2}$ | $C_{15}^{-2}$ | $C_{16}^{-2}$ | $C_{17}^{-2}$ | $C_{18}^{-2}$ |
| $C_{10}^{-3}$ | $C_{11}^{-3}$ | $C_{12}^{-3}$ | $C_{13}^{-3}$ | $C_{14}^{-3}$ | $C_{15}^{-3}$ | $C_{16}^{-3}$ | $C_{17}^{-3}$ | $C_{18}^{-3}$ |
| $C_{10}^{-4}$ | $C_{11}^{-4}$ | $C_{12}^{-4}$ | $C_{13}^{-4}$ | $C_{14}^{-4}$ | $C_{15}^{-4}$ | $C_{16}^{-4}$ | $C_{17}^{-4}$ | $C_{18}^{-4}$ |
| $C_{10}^{-5}$ | $C_{11}^{-5}$ | $C_{12}^{-5}$ | $C_{13}^{-5}$ | $C_{14}^{-5}$ | $C_{15}^{-5}$ | $C_{16}^{-5}$ | $C_{17}^{-5}$ | $C_{18}^{-5}$ |
| | $C_{11}^{-6}$ | $C_{12}^{-6}$ | $C_{13}^{-6}$ | $C_{14}^{-6}$ | $C_{15}^{-6}$ | $C_{16}^{-6}$ | $C_{17}^{-6}$ | $C_{18}^{-6}$ |
| | | | $C_{13}^{-7}$ | $C_{14}^{-7}$ | $C_{15}^{-7}$ | $C_{16}^{-7}$ | $C_{17}^{-7}$ | $C_{18}^{-7}$ |
| | | | | | $C_{15}^{-8}$ | $C_{16}^{-8}$ | $C_{17}^{-8}$ | $C_{18}^{-8}$ |
| | | | | | | | $C_{17}^{-9}$ | $C_{18}^{-9}$ |

For convenience these compounds will be further referred to as "isomers".

Not all of these isomers, nor all isomers of the same chain length, are equally effective as washing agents.

It has been discovered that only a very small group of specific isomers is particularly effective for use in detergent compositions, especially for dishwashing. The effective secondary alkyl sulphate isomers according to the invention are $C_{14}^{-2}$, $C_{15}^{-2/3/4/5/6}$, $C_{16}^{-3/4/5/6/7}$ and $C_{17}^{-7/8/9}$, especially the $C_{15}^{-2/3/4/5}$ and $C_{16}^{-4/5/6}$ secondary alkyl sulphate isomers.

Some of these isomers are particularly effective in hard water, some are typically good soft water detergents and others are effective in both hard and soft water.

Accordingly, it is an object of the present invention to provide secondary alkyl sulphates with better cleaning and foaming properties.

It is another object of the invention to provide secondary alkyl sulphates which are particularly suitable for use in dishwashing compositions.

Still another object of the invention is to provide an improved cleaning composition especially for dishwashing, comprising a secondary alkyl sulphate, which is effective in both hard and soft waters.

These and other objects which will be apparent from the following description are achieved by the use of a secondary alkyl sulphate selected from the group of effective isomers consisting of $C_{14}^{-2}$, $C_{15}^{-2/3/4/5/6}$, $C_{16}^{-3/4/5/6/7}$ and $C_{17}^{-7/8/9}$ secondary alkyl sulphate isomers and mixtures thereof. Preferred secondary alkyl sulphates are the $C_{15}^{-2/3/4/5}$ and $C_{16}^{-4/5/6}$ isomers.

If mixtures of isomers are used, the maximum content of 2/3 isomers is 50% in order to obtain a good diswashing performance in both hard and soft water.

It has been found that a secondary alkyl sulphate mixture, in order to be useful in the present invention, should consist of at least 40%, preferably at least 60% of effective secondary alkyl sulphate isomers.

Hence in one aspect of the invention a detergent composition comprising a $C_{10}$–$C_{18}$ secondary alkyl sulphate containing up to 50% of 2/3-sulphate isomers, and at least 40% of effective isomers selected from the group consisting of $C_{14}^{-2}$, $C_{15}^{-2/3/4/5/6}$, $C_{16}^{-3/4/5/6/7}$ and $C_{17}^{-7/8/9}$ isomers and mixtures thereof, preferably isomers selected from the group consisting of $C_{15}^{-2/3/4/5}$ and $C_{16}^{-4/5/6}$ isomers and mixtures thereof, and more preferably at least 60% of said effective isomers.

In another aspect of the invention a liquid detergent composition comprises 5 to 60% by weight of a $C_{10}$–$C_{18}$ secondary alkyl sulphate containing up to 50% of 2/3-sulphate isomers, and 40–100% of effective isomers selected from the group consisting of $C_{14}^{-2}$, $C_{15}^{-2/3/4/5/6}$, $C_{16}^{-3/4/5/6/7}$ and $C_{17}^{-7/8/9}$ isomers and mixtures thereof, preferably isomers selected from the group consisting of $C_{15}^{-2/3/4/5}$ and $C_{16}^{-4/5/6}$ isomers and mixtures thereof, more preferably 60–100% of said effective isomers.

The secondary alkyl sulphate as defined above can be used in the composition of the invention as the sole or principal detergent component, together with alkylbenzene sulphonate or preferably in conjunction with a co-surfactant as defined hereinafter.

Hence in a preferred aspect of the invention the liquid detergent composition further comprises a water-soluble co-surfactant selected from the group consisting of a nonionic condensation product obtained by condensing from 5–30 moles of an alkylene oxide, preferably ethylene or propylene oxide, with one mole of an organic compound, aliphatic or alkylaromatic in nature, having 8–24 carbon atoms and at least one reactive-hydrogen atom, particularly a reactive hydroxyl, amino, amido or carboxyl group; a $C_8$–$C_{20}$-alkyl sulphobetaine; an amine oxide containing one long chain alkyl moiety of from 10–28 carbon atoms and two moieties which can be either alkyl radicals or hydroxylalkyl radicals having from 1–4 carbon atoms; a $C_8$–$C_{20}$ alkyl polyethpxy sulphate having 1–25 ethylene oxide groups, and mixtures thereof.

The secondary alkyl sulphates most suitably used in the present invention are those having a narrow chain length range of 14–17 carbon atoms, preferably 15–16 carbon atoms, which are substantially free of other chain length compounds.

Secondary alkyl sulphates which contain 40–100% of $C_{15}^{-2/3/4/5}$ and $C_{16}^{-4/5/6}$ isomers are preferred. A still better performance is obtained if the secondary alkyl sulphate contains at least 60% of the preferred effective isomers.

Examples of nonionic condensation products which can be used in the present invention are:

(1) the condensates of ethylene oxide with aliphatic straight-chain or branched-chain, primary or secondary alcohols of 8–20 carbon atoms, such as those derived from tallow or coconut fatty acids, condensed with 4–20 ethylene oxide groups per molecule, and branched-chained $C_{11}$–$C_{15}$ alcohols condensed with 4–20 ethylene oxide groups;

(2) the condensates of ethylene oxide with alkylphenols, in which the phenols may be mono- or polyalkylated and the total number of carbon atoms in the side chain or chains is from 5 to 18. Specific examples are condensates of one mole nonylphenol with 8–15 moles ethylene oxide;

(3) the condensates of ethylene oxide with fatty acid esters, preferably mono-fatty acid esters of the sugar alcohols, sorbitol and manitol;

(4) polyethenoxy esters obtained by reacting ethylene oxide with carboxylic acids, which latter can be natural fatty acids or synthetic fatty acids made from paraffin wax having from 8–20 carbon atoms or alkylbenzoic or naphthenic acids having from 5–18 carbon atoms in the alkyl chain;

(5) the condensation products of fatty acyl alkanol amides of the type $C_7$–$C_{17}$ alkyl-CO—$NHC_2H_4OH$ or $C_7$–$C_{17}$ alkyl-CO—$N(C_2H_4OH)_2$ with at least 5 moles of ethylene oxide;

(6) the condensation products of $C_8$–$C_{18}$ alkyl-, $C_8$–$C_{18}$ alkenyl-, or $C_8$–$C_{18}$ alkylaryl amines with ethylene oxide; such as the condensation product of dodecylamine with 9–12 moles of ethylene oxide.

Specific examples of amine oxides are dimethyldodecyl amine oxide, diethyltetradecyl amine oxide, bis-(2-hydroxy-ethyl)-dodecyl amine oxide, and dimethyl-2-hydroxydodecyl amine oxide.

The secondary alkyl sulphate may be present in the liquid detergent composition of the invention in an amount of from 5–60% by weight, preferably 15–50% by weight, of the total composition. Advantageously the ratio by weight of secondary alkyl sulphate to co-surfactant should lie within the range of from 20:1 to 1:2, preferably from 10:1 to 1:1, more preferably from 9:1 to 4:1.

The liquid detergent composition of the invention may optionally contain other ingredients. Such optional ingredients include additional surfactants other than those specified according to the invention so long as they do not adversely affect the washing and foaming properties, e.g. alkylbenzene sulphonates and alkane sulphonates.

The presence of alkylbenzene sulphonates can have the additional advantage of lowering the clear and cloud points of the formulation so that less hydrotropes can be used.

It should however be borne in mind that the amount of alkylbenzene sulphonate should not be too high as its presence will then become detrimental. Essentially the ratio of alkylbenzene sulphonate to secondary alkyl sulphate in the composition of the invention should not exceed 80:20, preferably not exceed 60:40.

Other optional ingredients include sequestering agents e.g. polyphosphates, phosphonates, citric acid and the like; preservatives e.g. formaldehyde, boric acid, ethylene diamine tetraacetic acid; hydrotropes e.g. urea, ethanol, sodium toluene sulphonate and sodium xylene sulphonate; lather-promoting agents e.g. coconut fatty acid diethanolamide; perfume; colouring agents; pH-adjusting substances; germicides and skin benefit agents, such as proteins and protein derivatives.

If desired, other useful ingredients, such as casein and gelatin, may also be added.

EXAMPLE I

The following secondary alkyl sulphate (SALS)/$C_{12}$–$C_{15}$ primary alcohol-3-(ethoxy)-sulphate (LES) mixtures were tested for their washing performance using the Standard Plate Washing Test.

The test conditions applied were:

Active detergent concentration: 0.06%

Temperature of solution: 45° C.

Standard gravy soil at 5 g/plate: fat, starch, oleic and stearic acids.

The results are tabulated below:

TABLE A

| | Number of plates washed | | | |
|---|---|---|---|---|
| Water hardness | 24° H | | 5° H | |
| SALS/LES weight ratio | 1:1 | 4:1 | 1:1 | 4:1 |
| 1) Sodium tetradecane-2-sulphate ($C_{14}^{-2}$) | 31 | 36 | 39 | 37 |

TABLE A-continued

| Water hardness | Number of plates washed 24° H | | 5° H | |
|---|---|---|---|---|
| SALS/LES weight ratio | 1:1 | 4:1 | 1:1 | 4:1 |
| 2) Sodium pentadecane-6-sulphate ($C_{15}^{-6}$) | 38 | 37 | 33 | 35 |
| 3) Sodium hexadecane-6-sulphate ($C_{16}^{-6}$) | 28 | 28 | 44 | 45 |
| 4) Sodium tetradecane-6-sulphate ($C_{14}^{-6}$) | 32 | 39 | 18 | 17 |
| 5) Sodium hexadecane-2-sulphate ($C_{16}^{-2}$) | 20 | 19 | 33 | 31 |
| 6) Sodium hexadecane-8-sulphate ($C_{16}^{-8}$) | 22 | 22 | 29 | 30 |
| 7) Sodium heptadecane-6-sulphate ($C_{17}^{-6}$) | 16 | 13 | 31 | 32 |
| 8) $C_{14}$-$C_{16}$ SALS (56.6% ⅔ isomers; 67.4% effective isomers; 44.6% preferred isomers) | 32 | — | 22 | — |
| 9) $C_{14}$-$C_{17}$ SALS (91.5% ⅔ isomers; 83.6% effective isomers; 48.7% preferred isomers) | 30 | — | 23 | — |
| 10) $C_{14}$-$C_{17}$ SALS (21.5% ⅔ isomers; 49.4% effective isomers; 23.5% preferred isomers) | 42 | 44 | 40 | 43 |
| 11) $C_{15}$-$C_{16}$ SALS (24.6% ⅔ isomers; 68.3% effective isomers; 43.3% preferred isomers) | 49 | 51 | 57 | 59 |
| 12) $C_{13}$-$C_{14}$ SALS (60% ⅔ isomers; 30% effective isomers) | 32 | 33 | 23 | 21 |
| 13) $C_{16}$-$C_{18}$ SALS (83% ⅔ isomers; 20% effective isomers) | 17 | 19 | 23 | 25 |

The above results clearly show that mixtures Nos. 1–3 and 10–11 according to the invention are superior to mixtures Nos. 4–9 and 12–13 outside the invention.

EXAMPLE II

The following liquid detergent compositions were tested for their dishwashing performance using the Standard Plate Washing Test. The test conditions were the same as used in Example I.

The results are tabulated in Table B.

TABLE B

| Product composition | % by weight 2a | 2b | 2c | 2d |
|---|---|---|---|---|
| $C_{14}$-$C_{17}$ SALS (No. 10 of Example I) | 24 | 16 | — | — |
| $C_{15}$-$C_{16}$ SALS (No. 11 of Example I) | — | — | 24 | 16 |
| $C_{13}$-$C_{18}$-secondary alkane sulphonate | 8 | 16 | 8 | 16 |
| $C_{12}$-$C_{15}$-primary alcohol | 8 | 8 | 8 | 8 |

TABLE B-continued

| Product composition | % by weight 2a | 2b | 2c | 2d |
|---|---|---|---|---|
| 3(ethoxy)sulphate | | | | |
| Water | 60 | 60 | 60 | 60 |
| Number of plates washed in 24° H water | 31–32 | 35–36 | 29–28 | 31–33 |
| Number of plates washed in 5° H water | 45 | 49 | 48 | 53 |

EXAMPLE III

This example shows the effect of ratio of SALS to co-surfactant on the plates' washing capacity:

SALS No. 11 of Example I was used together with a $C_{12}$–$C_{15}$ primary alcohol-3(ethoxy)sulphate (=LES) as the co-surfactant.

The test conditions were the same as in Example I, except that two active detergent concentrations were used during the washings, viz 0.04% and 0.06%.

The following results were obtained:

TABLE C

| Water hardness | Active level | Ratio SALS : LES | | | | |
|---|---|---|---|---|---|---|
| | | 1:1 | 4:1 | 6:1 | 10:1 | 100% SALS |
| | SALS | 20% | 32% | 34.2% | 36.4% | 40% |
| | LES | 20% | 8% | 5.7% | 3.6% | 0% |
| | | Plates washed | | | | |
| 24° H | 0.04% | — | 27 | 29 | 25 | — |
| 24° H | 0.06% | 32 | 38 | 41 | 37 | 26 |
| 5° | 0.04% | — | 31 | 30 | 28 | — |
| 5° | 0.06% | 43 | 46 | 48 | 42 | 37 |

In a second test SALS No 11 of Example I was used together with a nonionic co-surfactant ($C_{12\text{-}15}$ alcohol condensed with 11 ethylene oxide units).

The following results were obtained:

TABLE D

| Water hardness | Active level | | Ratio SALS:nonionic | | |
|---|---|---|---|---|---|
| | | | 4:1 | 6:1 | 100% SALS |
| | | SALS | 32% | 34.2% | 40% |
| | | Non-ionic | 8% | 5.7% | 0% |
| 24° | 0.06% | | 37 | 37 | 26 |

EXAMPLE IV

Liquid compositions containing 40% (SALS+ABS+LES) were prepared at various ratios of SALS:ABS and plates rating tests were carried out therewith.

SALS=$C_{15}$–$C_{16}$ SALS No 11 of Example I

ABS=sodium dodecylbenzene sulphonate

LES=$C_{12}$–$C_{15}$ primary alcohol-3(ethoxy)-sulphate

The test conditions were the same as in Example I.

The following results were obtained:

TABLE E

| | | | | | | | | |
|---|---|---|---|---|---|---|---|---|
| Ratio SALS/ABS | SALS | 100 | 80 | 60 | 50 | 40 | 20 | 0 |
| | ABS | 0 | 20 | 40 | 50 | 60 | 80 | 100 |
| Composition | SALS | 34.3% | 27.44% | 20.58% | 17.15% | 13.72% | 6.86% | — |
| | ABS | — | 6.86 | 13.72 | 17.15 | 20.58 | 27.44 | 34.3% |
| | LES | 5.7% | 5.7 | 5.7 | 5.7 | 5.7 | 5.7 | 5.7 |
| | | Plates washed | | | | | | |
| Water hardness | | | | | | | | |
| 5° H | | 48 | 62 | 60 | 57 | 55 | 46 | 42 |

TABLE E-continued

| Ratio SALS/ABS | | | | | | | | |
|---|---|---|---|---|---|---|---|---|
| | SALS | 100 | 80 | 60 | 50 | 40 | 20 | 0 |
| | ABS | 0 | 20 | 40 | 50 | 60 | 80 | 100 |
| 24° H | | 41 | 42 | 42 | 40 | 38 | 35 | 30 |

EXAMPLE V

Liquid compositions containing 40% (SALS+SAS+LES) were prepared at various ratios of SALS:SAS and plates rating tests were carried out therewith.

SALS=$C_{15}$–$C_{16}$ SALS No 11 of Example I

SAS=$C_{14}$–$C_{17}$ secondary alkane sulphonate

LES=$C_{12}$–$C_{15}$ primary alcohol-3(ethoxy)-sulphate.

The same test conditions as in Example IV were used.

The following results were obtained:

TABLE F

| Ratio SALS/SAS | | | | | | | |
|---|---|---|---|---|---|---|---|
| | SALS | 100 | 80 | 60 | 40 | 20 | 0 |
| | SAS | 0 | 20 | 40 | 60 | 80 | 100 |
| Composition | SALS | 34.3% | 27.44% | 20.58% | 13.72% | 6.86% | — |
| | SAS | — | 6.86% | 13.72% | 20.58% | 27.44% | 34.3% |
| | LES | 5.7% | 5.7% | 5.7% | 5.7% | 5.7% | 5.7% |
| | | Plates washed | | | | | |
| Water hardness | | | | | | | |
| 5° | | 48 | 50 | 52 | 48 | 50 | 45 |
| 24° | | 41 | 34 | 34 | 36 | 39 | 34 |

EXAMPLE VI

The following compositions were prepared and their clear points and cloud points are given in the following Table G.

TABLE G

| Composition (% by weight) | A | B | C | D | E | F | G | H |
|---|---|---|---|---|---|---|---|---|
| SALS* | 35.2 | 33.4 | 31.6 | 28.1 | 24.6 | 21.0 | 17.6 | 24.6 |
| SAS* | — | — | — | — | — | — | — | 10.6 |
| ABS* | — | 1.8 | 3.6 | 7.1 | 10.6 | 14.2 | 17.6 | — |
| LES* | 5.8 | 5.8 | 5.8 | 5.8 | 5.8 | 5.8 | 5.8 | 5.8 |
| Ethanol | 8.8 | 8.8 | 8.8 | 8.8 | 8.8 | 8.8 | 8.8 | 8.8 |
| Urea | 8.5 | 8.5 | 8.5 | 8.5 | 8.5 | 8.5 | 8.5 | |
| Water | 41.7 | 41.7 | 41.7 | 41.7 | 41.7 | 41.7 | 41.7 | 41.7 |
| **Clear point (°C.) | +15 | +12.5 | +10 | +9.5 | +6.5 | −4 | −8.5 | +21 |
| Cloud point (°C.) | 0 | −1 | −2 | −8 | −9 | −9 | −9 | +6 |

*SALS = SALS No. 11 of Example I
SAS = $C_{14}$–$C_{17}$ secondary alkane sulphonate
ABS = sodium dodecylbenzene sulphonate
LES = $C_{12}$–$C_{15}$ primary alcohol-3(ethoxy)-sulphate.
**Definitions:
Clear point = the temperature at which a liquid composition, havingbeen cooled to well below its point of stability,clears upon being allowed to slowly warm up again.
Cloud point = the temperature at which the composition becomesturbid on slowly cooling the liquid composition.

EXAMPLE VII

The following series of compositions were prepared and subjected to the Standard Plate Washing Test as described in Example I.

| Composition series | a | b | c |
|---|---|---|---|
| SALS* | — | 17.3% | 34.3% |
| ABS | 34.3% | 17.3% | — |
| LES | 5.7% | 5.7% | 5.7% |
| Water | 60.0% | 59.7% | 60.0% |

*SALS = $C_{15}$–$C_{16}$ SALS sample No. 11 of Example I
ABS = alkylbenzene sulphonate
LES = $C_{12}$–$C_{15}$ primary alcohol-3(ethoxy)sulphate.

| Water hardness | Results: Mol. weight ABS | Number of plates washed a | b | c |
|---|---|---|---|---|
| 5° | 242 | 42 | 57 | 48 |
| 24° | 242 | 30 | 40 | 41 |
| 5° | 238 | 44 | 44 | 48 |
| 24° | 238 | 35 | 36 | 41 |
| 5° | 233 | 50 | 52 | 48 |
| 24° | 233 | 40 | 39 | 41 |
| 5° | 245 | 46 | 49 | 48 |
| 24° | 245 | 34 | 37 | 41 |
| 5° | 242 | 50 | 49 | 48 |
| 24° | 242 | 34 | 41 | 41 |

The results show that on the whole the composition series b and c of the invention are better than the composition series a outside the invention.

We claim:

1. A detergent composition comprising as active detergent component a $C_{10}$–$C_{18}$ secondary alkyl sulfate, said secondary alkyl sulfate containing up to 50% of 2- and 3-sulfate isomers and consisting of at least 40% of effective isomers selected from the group consisting of $C_{14}^{-2}$, $C_{15}^{-2/3/4/5/6}$, $C_{16}^{-3/4/5/6/7}$ and $C_{17}^{-7/8/9}$ sulfate isomers and mixtures thereof.

2. A detergent composition according to claim 1, wherein said secondary alkyl sulphate contains at least 60% of said effective isomers.

3. A detergent composition according to claim 1, wherein said effective isomers are selected from the group consisting of $C_{15}-^{2/3/4/5}$ and $C_{16}-^{4/5/6}$ isomers.

4. A liquid detergent composition comprising 5–60% by weight of a $C_{10}$–$C_{18}$ secondary alkyl sulfate, and optionally an alkylbenzenesulfonate in a ratio of 80:20 to 40:60, said secondary alkyl sulfate containing up to 50% of 2-and 3-sulfate isomers and consisting of at least 40% of effective isomers selected from the group consisting of $C_{14}-^{2}$, $C_{15}-^{2/3/4/5/6}$, $C_{16}-^{3/4/5/6/7}$ and $C_{17}-^{7/8/9}$ sulfate isomers and mixtures thereof.

5. A liquid detergent composition according to claim 4, wherein said secondary alkyl sulphate contains at least 60% of said effective isomers.

6. A liquid detergent composition according to claim 4, wherein said effective isomers are selected from the group consisting of $C_{15}-^{2/3/4/5}$ and $C_{16}-^{4/5/6}$ isomers.

7. A liquid detergent composition according to claim 4, which further comprises a water-soluble co-surfactant selected from the group consisting of (1) a nonionic condensation product obtained by condensing from 5–30 moles of an ethylene oxide or propylene oxide with one mole of an organic compound, aliphatic or aromatic in nature, having 8–24 carbon atoms and at least one reactive hydrogen atom;

(2) a $C_8$–$C_{20}$ alkyl sulphobetaine;

(3) an amine oxide containing one long-chain alkyl moiety of from 10–28 carbon atoms and two moieties which can be either alkyl radicals or hydroxyalkyl radicals having from 1–4 carbon atoms;

(4) a $C_8$–$C_{20}$ alkyl polyethoxy sulphate having 1–25 ethylene oxide groups, and mixtures thereof.

8. A liquid detergent composition according to claim 7, wherein said ratio is from 10:1 to 1:1.

* * * * *